US005632388A

United States Patent [19]

Morrison et al.

[11] Patent Number: 5,632,388

[45] Date of Patent: May 27, 1997

[54] TEST TUBE RACK ASSEMBLY

[75] Inventors: Charles R. Morrison, Marietta; Matthew E. Brooker, Beverly, both of Ohio

[73] Assignee: Forma Scientific, Inc., Marietta, Ohio

[21] Appl. No.: 380,059

[22] Filed: Jan. 30, 1995

[51] Int. Cl.[6] ..... A47F 7/00

[52] U.S. Cl. ..... 211/74; 211/170; 422/104

[58] Field of Search ..... 211/74, 170, 71; 206/443; 422/104

[56] References Cited

U.S. PATENT DOCUMENTS

| | | | |
|---|---|---|---|
| 2,532,604 | 12/1950 | Carski . | |
| 2,746,202 | 5/1956 | Barker . | |
| 2,755,018 | 7/1956 | Grela et al. . | |
| 3,109,084 | 10/1963 | Walsh . | |
| 3,142,385 | 7/1964 | Kahlenberg . | |
| 3,175,695 | 3/1965 | Goodman et al. . | |
| 3,184,071 | 5/1965 | Delaire . | |
| 3,674,198 | 7/1972 | Eberle . | |
| 3,744,665 | 7/1973 | Spoto . | |
| 3,871,832 | 3/1975 | Leblanc . | |
| 4,118,801 | 10/1978 | Kraft et al. . | |
| 4,135,660 | 1/1979 | Conn et al. . | |
| 4,202,634 | 5/1980 | Kraft et al. . | |
| 4,273,416 | 6/1981 | Blum . | |
| 4,281,768 | 8/1981 | Sommers | 211/74 |
| 4,284,603 | 8/1981 | Korom . | |
| 4,295,601 | 10/1981 | Cowell . | |
| 4,535,897 | 8/1985 | Remington et al. . | |
| 4,747,693 | 5/1988 | Kahl . | |
| 4,770,381 | 9/1988 | Gold . | |
| 4,787,523 | 11/1988 | Kalous . | |
| 4,817,650 | 4/1989 | Tilton . | |
| 4,932,533 | 6/1990 | Collier . | |
| 5,133,939 | 7/1992 | Mahe | 422/104 |
| 5,141,117 | 8/1992 | Olsen et al. . | |
| 5,148,919 | 9/1992 | Rubin | 206/443 |
| 5,169,603 | 12/1992 | Landsberger . | |

*Primary Examiner*—Robert W. Gibson, Jr.

[57] ABSTRACT

A test tube rack assembly including a test tube rack pivotally connected to a base having end support structure for allowing pivoting motion of the test tube rack with respect to a stationary base about a horizontal axis. A selectively actuable connector is affixed to at least one of the base end supports and includes a stud selectively engageable with one of a plurality stud receivers associated with the test tube rack for pivoting movement therewith. Each of the stud receivers defines a different angular position of the test tube rack with respect to the base. Preferably, a holder is disposed between the base and the test tube rack. A pair of holder end supports, comprising spring plates, have locking and alignment structure which mates with structure on the ends of the test tube rack to allow releasable, secure engagement between the holder and the rack.

32 Claims, 3 Drawing Sheets

TEST TUBE RACK ASSEMBLY

BACKGROUND OF THE INVENTION

The present invention generally relates to test tube holding apparatus and, more specifically, to a test tube rack assembly suitable for mounting a plurality test tubes during scientific procedures.

During scientific experimentation, such as biological testing procedures, it is often necessary to utilize a number of test tubes holding liquid culture specimens. The test tubes are generally held in racks while the culture specimens are grown. These racks may also be attached to shaking or stirring devices, such as orbital shaker tables, to mix the contents of the test tubes and enhance the culture growth activity. The test tubes may also be incubated, refrigerated and subjected to different lighting conditions during such experiments or culturing procedures.

As cultures are grown in test tubes, it is generally advantageous to maximize direct contact of the culture medium with air. Shaking the test tubes is one way to increase the exposure of culture medium to air at the top of the test tube. In this regard, shaking the culture medium creates a larger undulating surface area in the medium. Shaking also ensures that a greater volume of culture medium is brought to the surface to directly react with air at the top of the test tube.

Another manner of increasing the surface contact area of the culture medium with air for reaction purposes is to angle the test tubes from vertical such that the upper surface of the medium takes on a larger, oval shape. Various make-shift ways of accomplishing this have been used by scientists and other laboratory personnel. These have included leaning individual test tubes or the rack in which they are held against other structure at an angle and using tape to secure the test tubes against the structure as they are being stirred or shaken.

Certain test tube racks or holders have been proposed for orienting test tubes at an angle to increase the rate of culture growth by increasing surface area exposure of the culture. In this regard, U.S. Pat. No. 4,932,533 discloses a test tube transportation container having an insert for holding the test tubes and culture medium contained therein at a predetermined, fixed angle. This holder does not allow adjustment of the angle and, as it is designed for transportation or shipping purposes, the holder is not particularly well suited for laboratory use.

An adjustable test tube carrier is disclosed in U.S. Pat. No. 4,770,381. In this patent, one embodiment of the carrier is angularly adjustable by way of a curved slot which carries a threaded stud secured by a wing nut. The adjustment feature and other aspects of this holder suffer from certain disadvantages. For example, while the test tube carrier has two extreme angular positions defined at the ends of the curved slot, it does not provide the ability to repeatedly set the carrier at a plurality of discrete angular positions between these extremes. The lack of assurance that test tubes in different experiments or tests are being held at the same angle could lead to misleading results in some cases. Also, it may be awkward for one operator to angle the test tube carrier and then tighten down the wing nut while holding the test tube carrier at the desired angle. With a wing nut and threaded stud securing arrangement, there is also the possibility that the test tube carrier will loosen with respect to the stationary base during a shaking procedure.

Finally, the prior art suffers from still further disadvantages with respect to the ability of the test tube rack to be quickly and rigidly secured to a shaking apparatus. In order to obtain the rigid connection between the shaking apparatus and the test tube rack in the past, tedious fastening methods have been used which do not allow the entire rack full of test tubes to be quickly removed from a shaking apparatus, refilled with test tubes and replaced or alternatively replaced by another rack filled with test tubes. Therefore, setting up tests and experiments and changing over from one test tube rack to another has generally been a time consuming process.

It would therefore be desirable to provide a test tube rack assembly which allows versatile adjustment of the angle of the test tube rack and which includes other features which allow rigid attachment of the entire assembly to a shaking apparatus yet allow quick attachment and release of the test tube rack with respect to other support portions of the assembly.

SUMMARY OF THE INVENTION

It has therefore been one object of the present invention to enable orientation of a test tube rack at a plurality of discrete, repeatable angular positions separated by relatively small angular increments.

It has been another object of the invention to allow quick, rigid and releasable connection of a test tube rack to a mounting support or base structure.

It has been a further object of the invention to provide a test tube rack assembly which is easily used in conjunction with chest-like enclosures, such as incubators or refrigeration devices, having an upper opening through which the test tube rack is vertically inserted and removed.

To these ends, the test tube rack assembly of the present invention in one general aspect includes a base comprising a bottom support and a pair of upright end supports. A test tube rack is pivotally connected between the base end supports. The test tube rack also includes a pair of end supports with test tube supporting structure extending therebetween. A pivot connection is provided between the base end supports and the test tube rack end supports with the pivot connection allowing a pivoting motion of the test tube rack with respect to the base about a horizontal axis. A selectively actuable connector is affixed to at least one of the base end supports and includes a stud selectively engageable with one of a plurality stud receivers associated with the test tube rack for pivoting movement therewith. Each of the stud receivers defines a different angular position of the test tube rack with respect to the base.

In the preferred embodiment, the test tube rack assembly includes a test tube rack holder disposed between the test tube rack and the base. The test tube rack holder includes a pair of end supports which are each pivotally connected to a respective base end support by a pivot pin or rivet centrally disposed between front and rear edges of the base. The stud receivers preferably comprise arcuately spaced holes in the end supports of the holder and the selectively actuable connector is a spring-loaded plunger mechanism for moving the stud axially between engaged and disengaged positions with respect to the holes. The plunger is spring-biased to normally hold the stud in an engaged position and includes a hold-open feature allowing the stud to be temporarily held in a disengaged position as an angular adjustment is made to the holder and the rack.

The holder end supports and rack end supports have mating locking structure for allowing releasable, secure engagement between the holder and the rack. The holder end supports more specifically comprise upright spring plates which are normally disposed in a locking structure engagement position. The spring plates are capable of being spread or biased outwardly to both receive the test tube rack and disengage the locking structure during removal of the test tube rack.

In part, the locking structure of each spring plate is formed by inwardly extending portions of the spring plates which engage upwardly facing surfaces of the test tube rack end supports to prevent upward movement of the rack within the holder. In the preferred embodiment, these inwardly extending portions comprise inward bends in the spring plates. The spring plates are formed integrally with a bottom plate of the holder from a single sheet of resilient material, such as stainless steel. The spring plates are bent upwardly from the bottom plate and further bent to include the inward, locking bends mentioned above as well as upper, outward bends which act as cam surfaces. These cam surfaces allow the spring plates to be spread apart during insertion of the test tube rack.

The end supports of the test tube rack and holder also include mating alignment and locking structure for both aligning the test tube rack as it is inserted within the holder and preventing movement in forward rearward and downward directions with respect to the holder and base. The alignment and locking structure generally includes mating male and female portions of the rack and holder which allow insertion and removal of the rack in upward and downward directions. More specifically, respective recesses or cutouts are formed in the test tube rack end supports and these slidingly receive alignment members extending inwardly from the spring plates.

Further advantages and objects of the invention will become more readily apparent from the following detailed description of a preferred embodiment of the invention taken in conjunction with the accompanying drawings.

DETAILED DESCRIPTION OF THE PREFERRED EMBODIMENT

Figure 1:
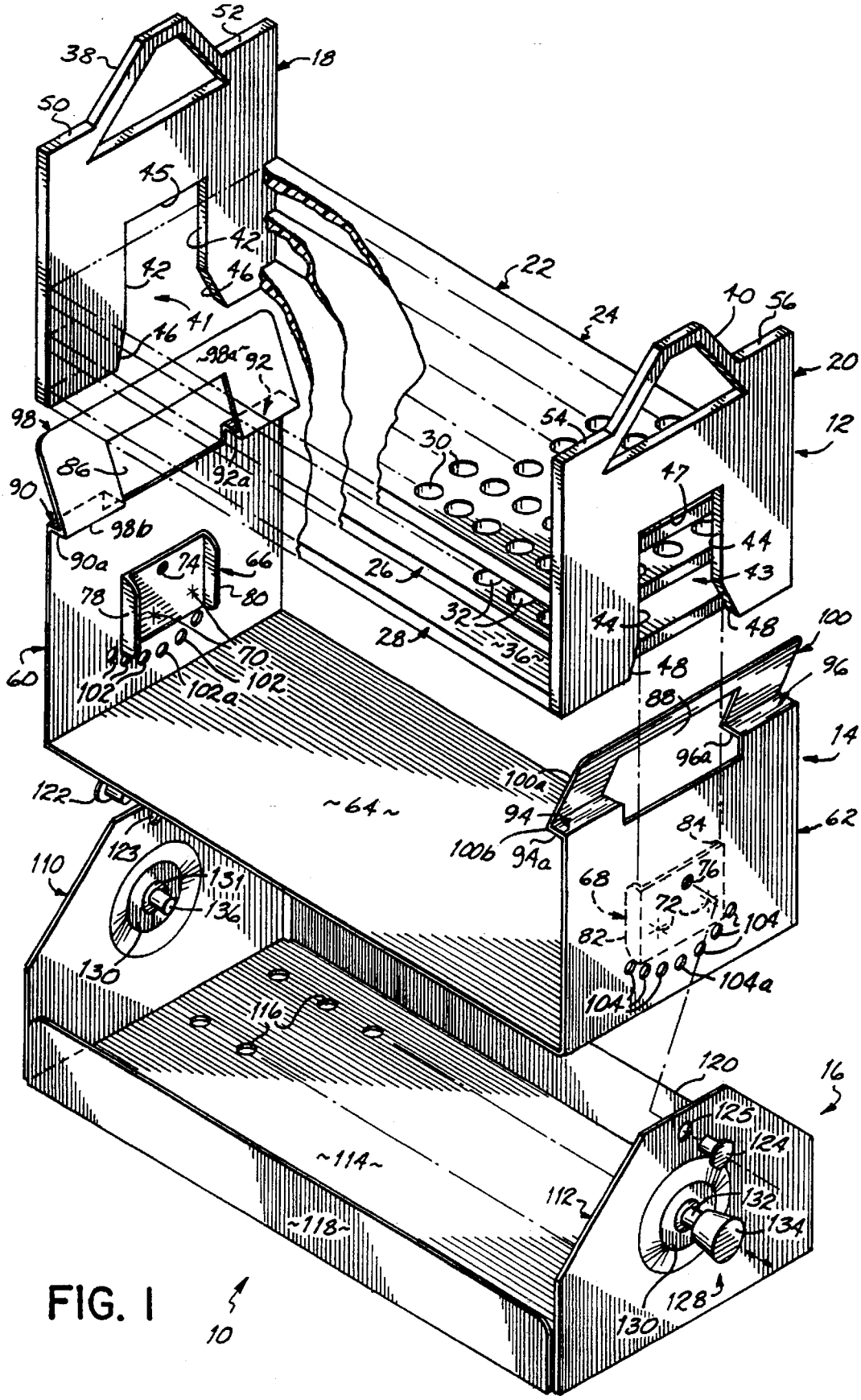
FIG. 1 is a partially fragmented exploded perspective of a test tube rack assembly constructed in accordance with a preferred embodiment of the invention.
Figure 2:
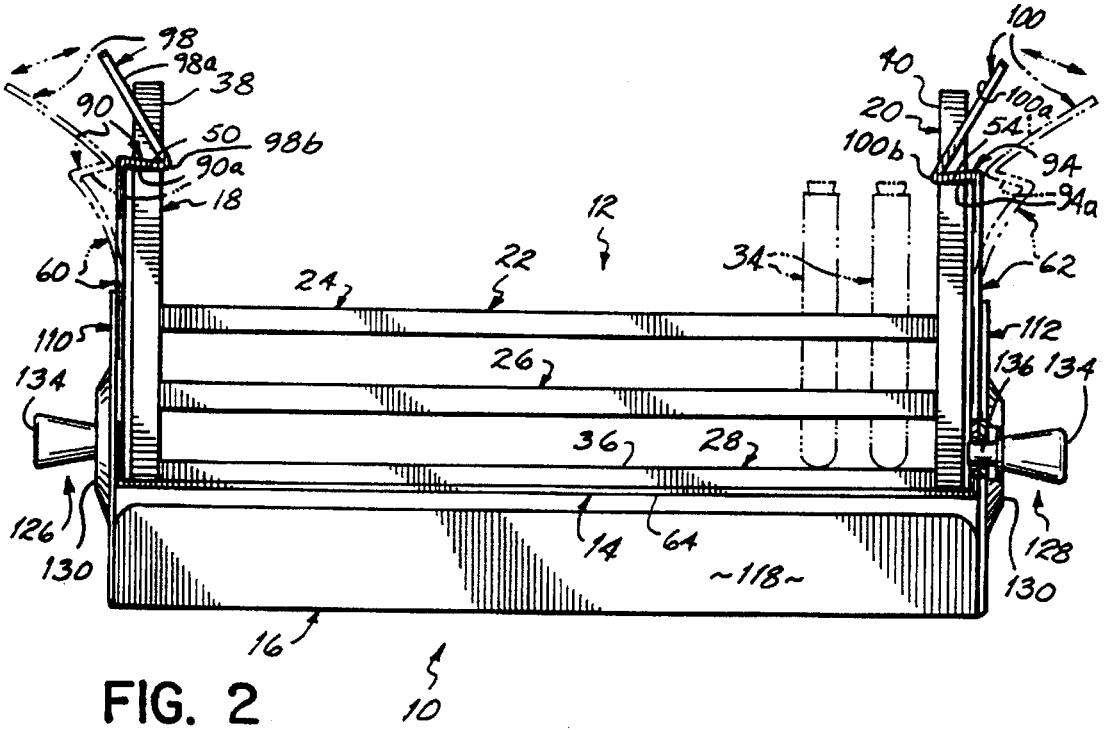
FIG. 2 is a side elevational view of the test tube rack assembly with the individual components fully assembled and oriented such that the test tubes are held vertically.
Figure 3:
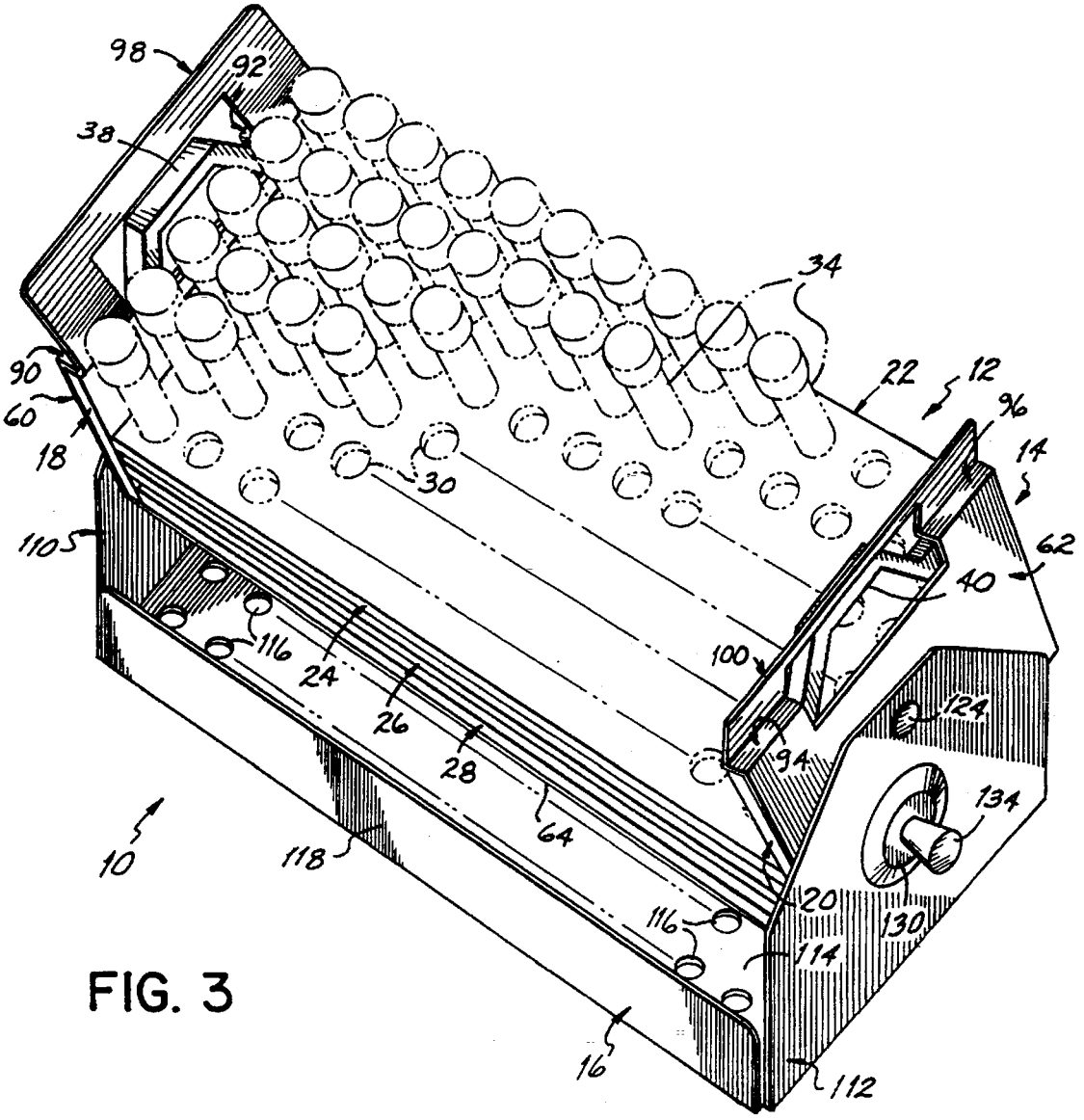
FIG. 3 is a perspective view of the test tube rack assembly with the test tube rack and holder pivoted and held at an angle with respect to the base.

Generally referring to FIGS. 1–3, the present invention is preferably embodied in a test tube rack assembly 10 including three major components. These components include a test tube rack 12, a test tube rack holder 14 and a base 16. As will be discussed in detail below, rack 12 and holder 14 pivot as a unit with respect to base 16 and may be locked at one of several discrete angles, such as the angle shown in FIG. 3. As will also be discussed below, holder 14 and test tube rack 12 are further designed to be connected together in a quickly releasable, yet stable manner.

Specifically, and as best shown in FIGS. 1 and 2, test tube rack 12 includes a pair of vertical end supports 18, 20 and test tube supporting structure 22 rigidly affixed therebetween. Test tube supporting structure 22 preferably comprises horizontally oriented, vertically spaced plates 24, 26, 28. The two upper plates 24, 26 have respective, aligned holes 30, 32. Test tubes 34 (FIG. 2) may be inserted through and laterally supported by respective vertically aligned holes 30, 32. As further shown in FIG. 2, test tubes 34 rest on upper surface 36 of bottom panel 28. End supports 18, 20 include handles 38, 40 for allowing rack 12 to be carried by the user and inserted and removed from holder 14.

Rack 12 also includes alignment and locking structure for engagement with mating structure of holder 14. With respect to rack 12, this structure includes alignment and locking recesses or cut-outs 41, 43 which provide for alignment and guidance as rack 12 is inserted and removed from holder 14 and, as discussed below, prevent forward, rearward and downward movement of rack 12 after it has been fully inserted into holder 14. Further locking structure is provided on rack 12 for preventing upward movement of rack 12 once it has been fully inserted into holder 14. This structure comprises upper surface portions 50, 52 of rack end support 18 and upper surface portions 54, 56 of rack end support 20 all of which are engaged by mating locking structure of holder 14 as described below.

As best illustrated in FIG. 1, test tube rack holder 14 includes a pair of end supports 60, 62 which preferably comprise spring locking members or plates. End supports or spring plates 60, 62 are formed integrally with a bottom support plate 64 from a sheet of resilient material. This material is preferably T-301 stainless steel which is 0.20 inches in thickness, however, it is contemplated that polymer or plastic materials or other metals may be used as well.

Still referring to FIG. 1, holder 14 includes male alignment structure, as mentioned above, which preferably comprises alignment members 66, 68 formed from the same plate material as spring plates 60, 62. Alignment members 66, 68 are permanently affixed to respective inside surfaces thereof by spot welds 70, 72 and clinching rivets 74, 76. Each alignment member 66, 68 includes respective inward bend portions 78, 80 and 82, 84 which essentially form rails to ride against the front and rear cut-out surfaces 42, 44 of recess or cut-out 41, 43. The lower end of each recess or cut-out 41, 43 further includes diverging or outwardly angled surfaces 46, 48. Surfaces 46, 48 effectively widen the lower portions of the respective recesses or cut-outs 41, 43 to allow easier location of the male alignment members or rails 66, 68 into recesses or cut-outs 41, 43. When rack 12 is fully inserted in a downward direction into holder 14, the upper ends of rails 78, 80 and 82, 84 stop further downward movement thereof by engaging upper surfaces 45, 47 of recesses or cut-outs 41, 43. Forward and rearward movement of rack 12 is prevented by engagement of rails 78, 80 and 82, 84 with front and rear surfaces 42, 44 of recesses or cut-outs 41, 43.

Referring now to FIGS. 1–3, holder end supports or spring plates 60, 62 include handle cut-outs 86, 88 which receive handles 38, 40 of rack 12 as shown in FIGS. 2 and 3. Each spring plate 60, 62 includes further locking structure comprising inward bend portions 90, 92 and 94, 96 on either side of handle cut-outs 86, 88 for respectively engaging upper surfaces 50, 52 and 54, 56 of rack 12. As will be appreciated from FIGS. 2 and 3, once rack 12 is fully inserted into holder 14, upward movement of rack 12 is prevented by engagement of lower surfaces 90*a*, 92*a* and 94*a*, 96*a* of bend portions 90, 92 and 94, 96 with upper surfaces 50, 52 and 54, 56 of rack end supports 18, 20.

To facilitate the insertion of rack 12 into holder 14, the upper ends 98, 100 of holder end supports or spring plates 60, 62 are bent outwardly from bend portions 90, 92 and 94, 96. As will be appreciated best from FIG. 2, during the downward insertion of rack 12 into holder 14, the bottoms of rack end supports 18, 20 will slide down the upper cam surfaces 98*a*, 100*a* and spread the upper portions of spring plates 60, 62 outwardly as shown in phantom lines. Once upper surfaces 50, 52 and 54, 56 of rack end supports 18, 20 pass the lower edges 98*b*, 100*b* of upper ends 98, 100, upper ends 98, 100 snap back into their normal upright position as shown in solid lines in FIG. 2. As will be discussed in detail below, each holder end support or spring plate 60, 62 further includes a plurality of arcuately spaced holes, including center holes 102*a*, 104*a*, which define a vertical orientation of rack 12 and holder 14 as well as additional arcuately spaced holes 102, 104 which allow discrete, repeatable angular adjustments to be made in the orientation of rack 12 and holder 14. Holes 102 and 104 are successively placed on both sides of the respective center holes 102*a*, 104*a* so as to define 15° angular increments in the adjustment of rack 12 and holder 14. Preferably, a total of 45° of adjustment is provided for in both directions relative to vertical. 0f course, the increments and total adjustment capabilities may be modified according to the needs of the application.

Referring again to FIG. 1, base 16 of assembly 10 comprises end supports 110, 112, a bottom panel 114 having mounting holes 116, as well as front and rear sides 118, 120. Holes 116 are used to accommodate fastening screws for holding base 16 to another structure, such as a shaking apparatus (not shown). As in the case of holder 14, base 16 is preferably formed from a single sheet of stainless steel by bending end supports 110, 112 and front and rear sides 118, 120 upwardly from bottom mounting plate 114. To provide for a more rigid structure, front and rear sides 118, 120 may be rigidly connected to end supports 110, 112, such as by welding at their junctions.

Pivot pins 122, 124 are provided to form a pivot connection between holder end supports or spring plates 60, 62 and base end supports 110, 112 in opposite directions about a horizontal axis 121. Pivot pins 122, 124 and axis 121 are disposed centrally between front and rear sides 118, 120 of base 112. Pivot pins 122, 124 preferably comprise shoulder rivets which extend through respective holes 123, 125 in base end supports 110, 112. As will further be appreciated best from FIG. 1, shoulder rivets 122, 124 further extend through the respective clinching rivets 74, 76 in spring plates 60, 62. Shoulder rivets 122, 124 are fastened conventionally between base end supports 110, 112 and spring plates 60, 62 such that holder 14 is pivotally supported on base 16.

Referring to FIGS. 1 and 2, each base end support 110, 112 further includes a selectively actuable connector 126, 128 which functions with holes 102*a*, 104*a* to lock rack 12 and holder 14 in a vertical orientation or with holes 102, 104 to lock rack 12 and holder 14 at any one of several discrete angular positions. Specifically, each connector comprises an identical spring-loaded plunger mechanism and therefore like reference numerals of each refer to identical structure in the drawings. The spring-loaded plungers of the preferred embodiment are manufactured by Southco, Inc. under part no. 56-10-301-20. Each spring-loaded plunger 126, 128 is mounted to a portion 130 of each base end support 110, 112 which has been punched or deformed outwardly approximately 0.120 inches for reasons to be discussed below.

Spring-loaded plungers 126, 128 include a cylindrical portion 132 which is rigidly fastened to the corresponding mounting portion 130 by a threaded sleeve 131, as shown in the left hand side of FIG. 1. As such, it will be appreciated that outwardly deformed mounting portions 30 prevent interference between sleeve 131 and the outer surfaces of spring plates 60, 62 during pivoting motion about axis 121. A stud 136, shown extending through sleeve 131 in the left hand side of FIG. 1, is movable with each handle 134 inwardly and outwardly with respect to sleeve 131 and with respect to holes 102, 104. Each handle 134 and attached stud 136 is spring biased in an inward or normally engaged position with respect to holes 102, 104 or 102*a*, 104*a*. The spring-loaded plungers 126, 128 of the preferred embodiment include a hold-open feature which allows stud 136 to be pulled outwardly and held in a disengaged position against the spring force by twisting handle 134 after pulling it out. This allows an operator to make the appropriate angular adjustment of rack 12 and holder 14 without manually holding each plunger 126, 128 with its stud 136 in a disengaged position during the adjustment.

Figure 4:
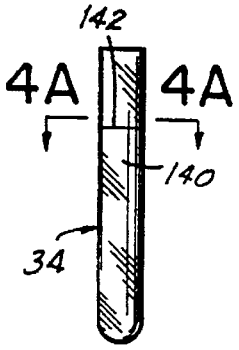
FIG. 4 is an elevational view of a vertically oriented test tube having liquid contained therein.
Figure 5:
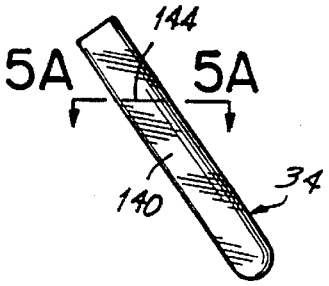
FIG. 5 is an elevational view of an angled test tube having liquid contained therein; and, FIG. 5A is a cross-sectional view taken along line 5A—5A of FIG. 5 to illustrate the oval-shaped surface of the liquid contained in the angled test tube.
Figure 4A:
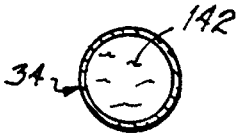
FIG. 4A is a cross-sectional view taken along line 4A—4A of FIG. 4 to illustrate the circular-shaped surface of the liquid contained in the vertical test tube.
Figure 5A:
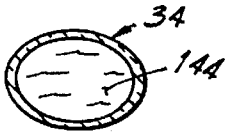

Angular orientation of test tubes 34 is often important to procedures involving the growth of cultures. It will be appreciated from FIGS. 4 and 4A that a vertically oriented test tube 34 holding a liquid culture medium 140 causes the medium to have circular surface area 142 (FIG. 4A). On the other hand, angling test tube 34 as shown in FIG. 5 causes culture medium 140 to have a larger oval shaped surface area 144. Surface area 144 exposes more of culture medium 140 to the air above culture medium 140. This results in faster culture growth. The present invention provides for a range of angles at which a plurality of test tubes 34 may be oriented and further provides for precise repeatability of such orientations. This repeatability is often important when conducting multiple tests or procedures which require the same control parameters for each procedure.

OPERATION

Referring first to FIG. 3, with holder 14 angled in the position shown, the front portion of base 16 may be rigidly secured to another structure, such as a shaking or stirring apparatus by inserting suitable fasteners (not shown), such as screws, through holes 116 as necessary. Rack 12 may optionally be inserted with holder 14 during the securement of base 16, however, it is easier to secure base 16 with rack 12 detached from holder 14. Holder 14 may then be adjusted to an oppositely angled orientation to that shown in FIG. 3 after pulling plungers 126, 128 outwardly into their hold-open positions to disengage studs 136 from holes 102, 104 (FIG. 1). The rear portion of base 16 may then be rigidly secured using additional fasteners inserted through an appropriate number of mounting holes 116 along a rear portion of base 16.

Referring now to FIGS. 1 and 2, with holder 14 preferably returned to a vertical orientation, rack 12 is snapped securely into place within holder 14 by simply sliding rack 12 downwardly into holder 14. The easy, vertically downward insertion of rack 14 into holder 14 is especially advantageous when base 16 and holder 14 are mounted within an enclosure, such as an incubator or refrigeration device, having a top opening. During the downward sliding motion of rack 12, spring plates 60, 62 will be spread outwardly as shown in dotted lines in FIG. 2 and then surfaces 42, 44 of alignment recesses or cut-outs 41, 43 will engage alignment members 78, 80 and 82, 84 in a sliding manner. Rack 12 may be pushed downwardly until upper surfaces 50, 52 and 54, 56 of rack end supports 18, 20 pass bends 98*b*, 100*b* in the respective spring plates 60, 62 and, simultaneously, upper ends of alignment members 78, 80 and 82, 84 abut against upper surfaces 45, 47 of recesses or cut-outs 41, 43. At this point, spring plates 60, 62 will return to their original upright or vertical position and bend portions 90, 92 and 94, 96, in conjunction with plates 66, 68 and recesses or cut-outs 41, 43, will lock rack 12 against any substantial movement with respect to holder 14.

Referring generally to FIGS. 1–3, to make the desired angular adjustment of test tubes 34, such as to the angle shown in FIG. 3, handles 134 on each side of base 16 are pulled outwardly and twisted into their hold-open positions to disengage studs 136 from holes 102*a*, 104*a*. Rack 12 and holder 14 may then be pivoted about axis 121 to the desired angle and both studs 136 of spring-loaded plungers 126, 128 may be re-engaged with holes 102, 104 corresponding to that angle. This is accomplished by twisting handles 134 in the opposite direction and allowing the spring force of each plunger 126, 128 to bias studs 136 inwardly into respective holes 102, 104.

To remove rack 12 from holder 14, assembly 10 is preferably returned to its vertical orientation as shown in FIG. 2 by disengaging and re-engaging plungers 126, 128 in center holes 102*a*, 104*a* (FIG. 1). Upper portions 98, 100 are then biased outwardly to disengage bends 90, 92 and 94, 96 and allow rack 12 to be lifted vertically out of holder 14.

Although the foregoing description details one preferred embodiment of the invention, Applicants' intention is not to be bound by such details. Rather, several inventive concepts and features have been disclosed by way of this detailed embodiment. Many modifications and substitutions for the details presented herein may be made without departing from the spirit and scope of the invention as covered by the appended claims.

What is claimed is:

1. An adjustable test tube rack assembly comprising:

a base having a pair of end supports;

a test tube rack including a pair of end supports and test tube supporting structure extending therebetween;

a pivot connection between said base end supports and said test tube rack end supports, said pivot connection allowing a pivoting motion of said test tube rack with respect to said base about a horizontal axis; and, a selectively actuable connector affixed to at least one of said base end supports and including a stud selectively engageable with one of a plurality stud receivers associated with said test tube rack and moving therewith during said pivoting motion, wherein each of said stud receivers defines a different angular position of said test tube rack with respect to said base.

2. The test tube rack assembly of claim 1 further comprising a test tube rack holder disposed between said test tube rack and said base, said test tube rack holder including a pair of end supports which are each pivotally connected to a respective base end support, said test tube rack holder end supports further having locking structure for holding said test tube rack in fixed relation to said test tube rack holder.

3. The test tube rack assembly of claim 2 wherein said locking structure on the end supports of said test tube rack and said test tube rack holder allows removable attachment between said test tube rack and said test tube rack holder.

4. The test tube rack assembly of claim 3 wherein said test tube rack holder end supports comprise upright spring plates which are normally disposed in a locking structure engagement position, said spring plates further capable of being spread outwardly to both receive said test tube rack and disengage said locking structure during removal of said test tube rack.

5. The test tube rack assembly of claim 4 wherein said locking structure further comprises inwardly extending portions of said spring plates which are adapted to engage upwardly facing surfaces of said test tube rack end supports.

6. The test tube rack assembly of claim 5 wherein said inwardly extending portions comprise inward bends in said spring plates.

7. The test tube rack assembly of claim 2 wherein said stud receivers comprise holes in said test tube rack holder end supports and said selectively actuable connector is a plunger mechanism for moving said stud axially between engaged and disengaged positions with respect to said holes.

8. The test tube rack assembly of claim 7 wherein said plunger is biased to normally hold said stud in said engaged position.

9. The test tube rack assembly of claim 8 wherein said plunger includes a hold-open lock allowing said stud to be selectively held in a disengaged position.

10. The test tube rack of claim 2 wherein the end supports of said test tube rack and said test tube rack holder include mating alignment structure for aligning said test tube rack and said test tube rack holder as said locking structure is engaged.

11. The test tube rack of claim 10 wherein said test tube rack holder end supports comprise upright spring plates which are normally disposed in a locking structure engagement position, said spring plates further capable of being spread outwardly to both receive said test tube rack and disengage said locking structure during removal of said test tube rack, said alignment structure including respective slots in said test tube rack end supports adapted to receive alignment members extending inwardly from said spring plates.

12. The test tube rack assembly of claim 1 wherein said horizontal axis is disposed centrally between front and rear sides of said base and said pivot connection allows pivoting of said test tube rack in opposite directions about said horizontal axis.

13. An adjustable test tube rack assembly comprising:

a base having a pair of end supports;

a pair of spring locking members respectively mounted to said base end supports;

a test tube rack including a pair of end supports and test tube supporting structure extending between said end supports; and, wherein said spring locking members and said test tube rack end supports respectively include mating locking surfaces and said spring locking members are movable between locked and unlocked positions with respect to the locking surfaces of said test tube rack end supports to allow said test tube rack to be selectively engaged and disengaged by said locking members.

14. The test tube rack assembly of claim 13 wherein said spring locking members form part of a test tube rack holder having a bottom support extending between said spring locking members.

15. The test tube rack assembly of claim 14 wherein said bottom support and said spring locking members comprise a plate integrally formed from a single sheet of resilient material.

16. The test tube rack assembly of claim 15 wherein said sheet of resilient material is a metal sheet.

17. The test tube rack assembly of claim 14 wherein said test tube rack holder is pivotally mounted to said base to allow movement about a central horizontal axis of said base.

18. The test tube rack assembly of claim 17 wherein said horizontal axis is disposed centrally between front and rear sides of said base and said pivot connection allows pivoting of said test tube rack in opposite directions about said horizontal axis.

19. The test tube rack assembly of claim 13 wherein the locking surfaces of said spring locking members face downwardly and are disposed on inwardly extending portions of said spring locking members and the locking surfaces of said test tube rack end supports face upwardly, whereby said spring locking members may be biased outwardly to receive said test tube rack and then allowed to retract inwardly such that adjacent locking surfaces engage each other to lock said test tube rack in place between said spring locking members.

20. The test tube rack assembly of claim 19 wherein said spring locking members are resilient plates and said inwardly extending portions comprise inward bend portions in said resilient plates.

21. The test tube rack assembly of claim 20 wherein said resilient plates each further include a second bend portion extending upwardly and outwardly from said inward bend portions and said test tube rack is sized such that the end supports thereof contact the second bend portions and spread said resilient plates apart during insertion of said test tube rack therebetween.

22. The test tube rack assembly of claim 13 wherein said spring locking members and said test tube rack end supports further include mating alignment structure for aligning said test tube rack and said spring locking members as the respective locking surfaces thereof are engaged.

23. The test tube rack of claim 22 wherein said spring locking members comprise upright spring plates which are normally disposed in a locking surface engagement position, said spring plates further capable of being spread outwardly to both receive said test tube rack and disengage said locking surfaces during removal of said test tube rack.

24. The test tube rack of claim 23 wherein said alignment structure includes respective slots in said test tube rack end supports and alignment members extending inwardly from said spring plates.

25. A test tube rack assembly comprising:

a base having a pair of end supports;

a pair of aligning members respectively connected to said base end supports;

a pair of locking members respectively connected to said base end supports;

a test tube rack including a pair of end supports and test tube supporting structure extending therebetween, said test tube rack end supports including aligning structure for cooperating in a sliding manner with said aligning members during insertion and removal of said test tube rack between said base end supports and further including locking structure for cooperating with said locking members when said test tube rack is inserted between said base end supports.

26. The test tube rack assembly of claim 25 wherein said aligning members and said locking members each extend inwardly from the respective base end supports.

27. The test tube rack assembly of claim 26 wherein the aligning structure of each test tube rack end support comprises a recess for receiving an alignment member in a sliding manner.

28. The test tube rack assembly of claim 27 wherein the locking structure of each test tube rack end support comprises an upwardly facing surface thereof for engaging a downwardly facing surface of a respective locking member.

29. The test tube rack assembly of claim 28 further comprising a test tube rack holder carrying said alignment and locking members and comprising a resilient plate integrally formed with a bottom plate portion and a pair of spring plates extending upwardly from opposite ends thereof, said spring plates being pivotally connected to said base end supports.

30. The test tube rack assembly of claim 29 wherein said sheet of resilient material is a metal sheet.

31. The test tube rack assembly of claim 29 wherein said locking members comprise respective inward bend portions in said spring plates and said alignment members each comprise alignment plates rigidly affixed to inner surfaces of said spring plates and having end portions bent in an inward direction.

32. The test tube rack assembly of claim 31 wherein said spring plates each further include a second bend portion extending upwardly and outwardly from said inward bend portions and said test tube rack is sized such that the end supports thereof contact the second bend portions and spread said spring plates apart during insertion of said test tube rack therebetween.

* * * * *